United States Patent [19]

Hunter et al.

[11] Patent Number: 4,908,100

[45] Date of Patent: Mar. 13, 1990

[54] HYDROLYZED POLYACRYLAMIDE BLENDS AS STARCH RETENTION AIDS

[75] Inventors: W. E. Hunter, Pittsburgh; Ronald J. Falcione, Canonsburg, both of Pa.

[73] Assignee: Calgon Corporation, Pittsburgh, Pa.

[21] Appl. No.: 310,415

[22] Filed: Feb. 13, 1989

[51] Int. Cl.[4] ..... D21H 3/38

[52] U.S. Cl. ..... 162/168.3; 162/175

[58] Field of Search ..... 162/168.3, 183, 175

[56] References Cited

U.S. PATENT DOCUMENTS 3,725,195 4/1973 Suyama et al. ..... 162/168.3

*Primary Examiner*—Peter Chin

*Attorney, Agent, or Firm*—W. C. Mitchell; J. F. DiPrima

[57] ABSTRACT

A method of improving the retention of starch in papermaking using blends of high and low molecular weight acrylic acid/acrylamide copolymers.

2 Claims, No Drawings

HYDROLYZED POLYACRYLAMIDE BLENDS AS STARCH RETENTION AIDS

BACKGROUND OF THE INVENTION

This invention relates to a method for improving starch retention in papermaking using admixtures of acrylic acid/acrylamide-type polymers. Filler retention and wire drainage are also improved, without adversely affecting sheet formation. These synergistic polymer compositions are preferably high charge density blends of high and low molecular weight anionic emulsion polymers.

U.S. Pat. No. 4,643,801 discloses the use of compositions containing a cationic starch, an acrylic acid/acrylamide copolymer and dispersed silica as binders in papermaking. The patent does not disclose, however, the instant high and low molecular weight polymer blends.

The inventors have discovered that polymer blends comprising acrylic acid/acrylamide-type polymers of different molecular weights greatly improve starch retention in papermaking. Unretained starch in a paper system may cause excessive foaming and deposit-related problems. Past practice required that mills either limit starch usage or use defoamers. Attempts to use conventional retention aids sometimes caused over-floccing, which adversely affected sheet properties. These problems are remedied by the instant method.

DETAILED DESCRIPTION OF THE INVENTION

The instant invention is directed to a method of improving starch retention, particularly retention of cationic starches, during papermaking by adding to an aqueous papermaking stock an effective amount of a composition comprising: (a) a polymer having a molecular weight of from about 2,000,000 to about 8,000,000, as determined by capillary viscosity measurements, comprising about 5 to about 50%, by weight, of acrylic acid or methacrylic acid and from about 50 to about 95%, by weight, of acrylamide or methacrylamide, and salts of such polymers; and (b) a polymer having a molecular weight of from about 10,000,000 to about 20,000,000, as determined by capillary viscosity measurements, comprising about 5 to about 50%, by weight, acrylic acid or methacrylic acid and from about 50 to about 95%, by weight, of acrylamide or methacrylamide, and salts of such polymers, wherein the ratio of (a):(b) ranges from about 95:5 to about 5:95, by weight, preferably from about 95:5 to about 40:60. Preferably, the polymers of both (a) and (b) are copolymers of acrylic acid and acrylamide which contain from about 5 to about 50%, by weight, carboxylate functionalty. Such polymers can be prepared by copolymerizing the monomers or by hydrolyzing a polyacrylamide.

Additionally, the instant invention is directed to novel compositions which comprise (a) an aqueous papermaking stock (b) the above described polymer composition; and (c) a starch. Silica is not required in these compositions.

Thus, the inventors have discovered that specific blends of acrylic acid/acrylamide-type polymers having relatively low and high molecular weights unexpectedly improve starch retention in papermaking. Any type of starch can be used, including all types of amphoteric starches and cationic starches such as cationic potato starches and cationic corn starches.

Any polymer comprising monomers selected from the group consisting of (i) acrylic acid and methacrylic acid, alone or in combination with each other, and (ii) acrylamide and methacrylamide, alone or in combination with each other,and salts of such polymers, can be used. Copolymers of acrylic acid and acrylamide and hydrolyzed polyacrylamides are preferred.

Preferably, components (a) and (b) are polymers prepared from the same monomer(s), differing only in weight average molecular weight. However, compositions which comprise high and low molecular weight combinations of different polymers can also be used.

The polymer of component (a) should have a molecular weight ranging from about 2,000,000 to about 8,000,000, as determined by capillary viscosity. The polymer of component (b) should have a molecular weight of about 10,000,000 to about 20,000,000, as determined by capillary viscosity. While the polymers comprising the instant compositions can be prepared in several forms, the preferred polymers are water-in-oil emulsion polymers prepared by a water-in-oil emulsion polymerization process which comprises:

(1) forming a water-in-oil emulsion of an aqueous monomer solution comprising (i) acrylic acid and/or methacrylic acid and (ii) acrylamide and/or methacrylamide in an inert hydrophobic liquid organic dispersion medium; and (2) polymerizing the monomer or monomers in the dispersion medium to form a polymer emulsion. Such a process is described in U.S. Pat. No. 4,672,090, which is incorporated into this specification by reference.

An effective amount of the instant polymer compositions should be used. As used herein, the term "effective amount" refers to that amount of an instant polymer composition necessary to provide improved starch retention in the papermaking system being treated. The preferred dosage is from about 0.25 to about 5.0 lbs. of the polymer composition, on an active polymer weight basis, per ton of stock, based on the solids in the stock solution, though optimum treatment levels may exceed this range in some cases. The polymer compositon may be added by an convenient means. Preferably, it is added to the approach flow system of the machine headbox being treated.

The polymer blends can be prepared by any convenient method. Also, the polymer components of the instant compositions can be added separately as an alternative to adding blended compositions.

The key to this invention is that polymer blends which comprise polymers of low and high molecular weight greatly improve starch retention, as measured by the strength of formed paper sheets and/or by a decrease in foaming.

EXAMPLES

Examples 1–31

The following examples demonstrate the instant invention in greater detail. These examples should not, however, be viewed as limiting the invention in any way.

The following polymers were used in the examples:

Polymer A (Low molecular weight HYPAM)—This polymer is a 30% hydrolyzed polyacrylamide emulsion having a molecular weight of approximately 5,000,000, as determined by capillary viscosity measurements. This polymer is commercially available from Calgon Corporation as Hydraid TRP-952.

Polymer B (High molecular weight HYPAM)—This polymer is a 30% hydrolyzed polyacrylamide emulsion having a molecular weight of approximately 15,000,000, as determined by capillary viscosity measurements. This polymer is commercially available from Calgon Corporation as Hydraid 7736EZ.

The polymers were added to a fine paper ground wood/Kraft furnish stock solution containing 0.5048%, by weight, solids, of which 38.8%, by weight, were fiber and filler fines. Of the fines fraction, 9.7%, by weight, was ash. The pH was 4.5. After the polymers were added, first pass fines retention was measured via Britt Jar techniques. Starch dosages varied as shown in Table I. A cationic corn starch was used in the tests.

TABLE I

| Example No. | Starch Dosage (lbs/ton) | Active Weight % Polymer A | Active Weight % Polymer B | Polymer Feed Rate Active Polymer (lbs/ton) | Retention Fines (%) |
|---|---|---|---|---|---|
| 1 | — | — | — | — | 19.8 |
| 2 | 15.0 | — | — | — | 26.1 |
| 3 | 15.0 | 100 | 0 | 0.5 | 25.2 |
| 4 | 15.0 | 90 | 10 | 0.5 | 26.9 |
| 5 | 15.0 | 80 | 20 | 0.5 | 28.9 |
| 6 | 15.0 | 100 | 0 | 1.0 | 26.0 |
| 7 | 15.0 | 90 | 10 | 1.0 | 26.4 |
| 8 | 15.0 | 80 | 20 | 1.0 | 26.1 |
| 9 | 15.0 | 100 | 0 | 2.0 | 27.0 |
| 10 | 15.0 | 90 | 10 | 2.0 | 28.6 |
| 11 | 15.0 | 80 | 20 | 2.0 | 30.5 |
| 12 | 20.0 | — | — | — | 26.7 |
| 13 | 20.0 | 100 | 0 | 0.5 | 26.3 |
| 14 | 20.0 | 90 | 10 | 0.5 | 25.5 |
| 15 | 20.0 | 80 | 20 | 0.5 | 26.9 |
| 16 | 20.0 | 100 | 0 | 1.0 | 26.9 |
| 17 | 20.0 | 90 | 10 | 1.0 | 29.1 |
| 18 | 20.0 | 80 | 20 | 1.0 | 28.0 |
| 19 | 20.0 | 100 | 0 | 2.0 | 26.9 |
| 20 | 20.0 | 90 | 10 | 2.0 | 28.0 |
| 21 | 20.0 | 80 | 20 | 2.0 | 30.2 |
| 22 | 25.0 | — | — | — | 27.2 |
| 23 | 25.0 | 100 | 0 | 0.5 | 27.4 |
| 24 | 25.0 | 90 | 10 | 0.5 | 30.2 |
| 25 | 25.0 | 80 | 20 | 0.5 | 29.9 |

TABLE I-continued

| Example No. | Starch Dosage (lbs/ton) | Active Weight % Polymer A | Active Weight % Polymer B | Polymer Feed Rate Active Polymer (lbs/ton) | Retention Fines (%) |
|---|---|---|---|---|---|
| 26 | 25.0 | 100 | 0 | 1.0 | 29.1 |
| 27 | 25.0 | 90 | 10 | 1.0 | 28.1 |
| 28 | 25.0 | 80 | 20 | 1.0 | 28.0 |
| 29 | 25.0 | 100 | 0 | 2.0 | 30.8 |
| 30 | 25.0 | 90 | 10 | 2.0 | 31.0 |
| 31 | 25.0 | 80 | 20 | 2.0 | 31.2 |

What is claimed is:

1. A method of improving starch retention in papermaking comprising adding an effective amount of composition comprising:

(a) a polymer having a molecular weight of from about 2,000,000 to about 8,000,000 which comprises from about 5 to about 50%, by weight, of acrylic acid or methacrylic acid and from about 50 to about 95%, by weight, of acrylamide or methacrylamide; and (b) a polymer having a molecular weight of from about 10,000,000 to about 20,000,000 which comprises from about 5 to about 50%, by weight, acrylic acid or methacrylic acid and from about 50 to about 95%, by weight, of acrylamide or methacrylamide; to an aqueous papermaking stock solution containing starch, wherein the weight ratio of (a):(b) ranges from about 95:5 to about 5:95, on an active basis.

2. A composition comprising:

(a) an aqueous papermaking stock solution;

(b) starch; and (c) a composition comprising:

(i) a polymer having a molecular weight of from about 2,000,000 to about 8,000,000 which comprises from about 5 to about 50%, by weight, of acrylic acid or methacrylic acid and from about 50 to about 95%, by weight, of acrylamide or methacrylamide; and (ii) a polymer having a molecular weight of from about 10,000,000 to about 20,000,000 which comprises from about 5 to about 50%, by weight, acrylic acid or methacrylic acid and from about 50 to about 95%, by weight, of acrylamide or methacrylamide; wherein the weight ratio of (i):(ii) ranges from about 95:5 to about 5:95, on an active basis and wherein an effective amount of (c) for the purpose of improving starch retention is present.

* * * * *